US006273217B1

(12) United States Patent
Hikita

(10) Patent No.: US 6,273,217 B1
(45) Date of Patent: Aug. 14, 2001

(54) ELEVATOR GROUP CONTROL APPARATUS FOR MULTIPLE ELEVATORS IN A SINGLE ELEVATOR SHAFT

(75) Inventor: Shiro Hikita, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/384,341

(22) Filed: Aug. 27, 1999

(30) Foreign Application Priority Data

Feb. 3, 1999 (JP) ..... 11-025949

(51) Int. Cl.[7] ..... B66B 1/16
(52) U.S. Cl. ..... 187/388; 187/382
(58) Field of Search ..... 187/380, 382, 187/388, 394

(56) References Cited

U.S. PATENT DOCUMENTS 5,107,962 * 4/1992 Ekholm ..... 187/16
5,419,414 * 5/1995 Sakita ..... 187/391
5,663,538 * 9/1997 Sakita ..... 187/382
5,865,274 * 12/1999 Kiji et al. ..... 187/380
5,877,462 * 3/1999 Chenais ..... 187/249

FOREIGN PATENT DOCUMENTS 8133611 5/1996 (JP) .

* cited by examiner

*Primary Examiner*—Jonathan Salata
(74) *Attorney, Agent, or Firm*—Leydig, Voit & Mayer, Ltd.

(57) ABSTRACT

An elevator group control apparatus for controlling operations of an elevator system with multiple cars moving within a single elevator shaft with improved efficiency without a collision between the cars. When an elevator-hall call is registered, first and second times at which individual cars are expected to arrive at individual floors where the elevator-hall call is registered are computed. The probability of occurrence of a collision between the cars is computed, determining whether a remaining car in the shaft must be shunted. A shunting floor is designated if necessary.

7 Claims, 10 Drawing Sheets

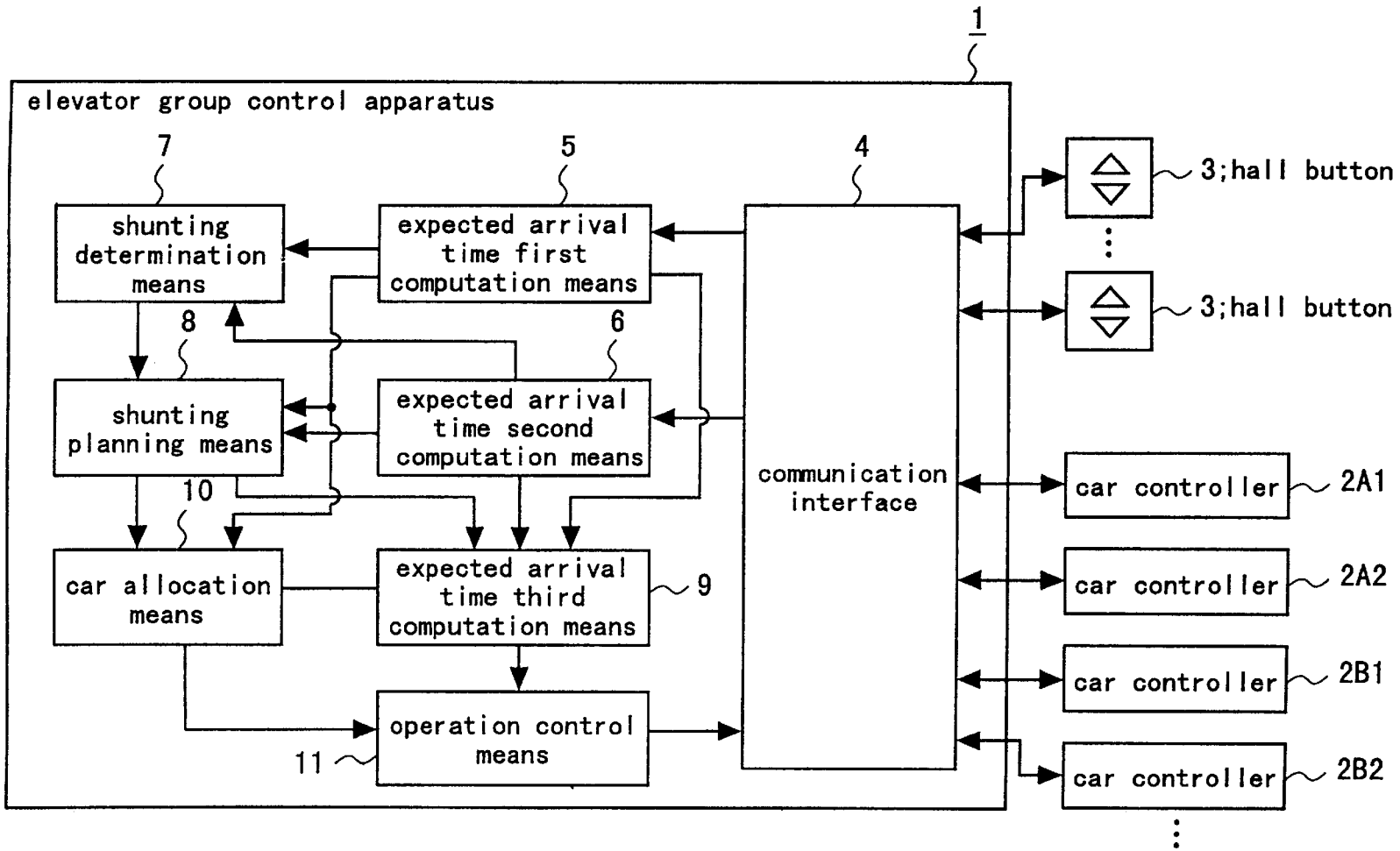
FIG. 1
1
elevator group control apparatus
3;hall button
3;hall button
2A1
2A2
2B1
2B2
car controller
car controller
car controller
car controller
4
communication interface
5
expected arrival time first computation means
6
expected arrival time second computation means
9
expected arrival time third computation means
operation control means
11
7
shunting determination means
8
shunting planning means
10
car allocation means

FIG. 5A with temporarily assignment of elevator-hall call (unit:sec)

| | 1 F | 2 F | 3 F | 4 F | 5 F | 6 F | 7 F | 8 F | 9 F | 10 F |
|---|---|---|---|---|---|---|---|---|---|---|
| UP | 0 | 2 | 4 | 17.43 | 20.86 | 24.29 | 27.72 | 31.15 | 34.58 | - |
| DOWN | - | 64 | 62 | 60 | 58 | 56 | 54 | 52 | 50 | 38 |

FIG. 5B without temporarily assignment of elevator-hall call (unit:sec)

| | 1 F | 2 F | 3 F | 4 F | 5 F | 6 F | 7 F | 8 F | 9 F | 10 F |
|---|---|---|---|---|---|---|---|---|---|---|
| UP | 0 | 2 | 4 | 6 | 8 | 10 | 12 | 14 | 16 | - |
| DOWN | - | 2 | 4 | 6 | 8 | 10 | 12 | 14 | 16 | 18 |

FIG. 6

| | shunting floor | shunting start time | shunting travel time | expected arrival time |
|---|---|---|---|---|
| temporary assign to A1 | shunt A2 to 11F | 0(upper car A2) | 12(upper car A2) | modify A2 only |
| temporary assign to B1 | shunt B2 to 11F | 0(upper car B2) | 22(upper car B2) | modify B2 only |
| temporary assign to C1 | shunt C2 to 11F | 14(upper car C2) | 18(upper car C2) | modify C2 only |
| temporary assign to D1 | shunt D2 to 11F | 26(upper car D2) | 18(D2)+10(D1) | modify D1,D2 |

(unit:sec)

FIG. 9A with temporarily assignment of elevator-hall call(unit:sec)

| | 1 F | 2 F | 3 F | 4 F | 5 F | 6 F | 7 F | 8 F | 9 F | 10 F |
|---|---|---|---|---|---|---|---|---|---|---|
| UP | 0 | 2 | 4 | 16 | 18 | 20 | 32 | 34 | 36 | – |
| DOWN | – | 38 | 36 | 34 | 32 | 20 | 32 | 34 | 36 | 38 |

FIG. 9B without temporarily assignment of elevator-hall call(unit:sec)

| | 1 F | 2 F | 3 F | 4 F | 5 F | 6 F | 7 F | 8 F | 9 F | 10 F |
|---|---|---|---|---|---|---|---|---|---|---|
| UP | 0 | 2 | 4 | 6 | 8 | 10 | 12 | 14 | 16 | – |
| DOWN | – | 2 | 4 | 6 | 8 | 10 | 12 | 14 | 16 | 18 |

FIG. 10

| | shunting floor | shunting start time | shunting travel time | expected arrival time |
|---|---|---|---|---|
| temporary assign to A1 | not shunt | 0 | 0 | not modify |
| temporary assign to B1 | shunt B2 to 7F | 0(upper car B2) | 14(upper car B2) | modify B2 only |
| temporary assign to C1 | not shunt | 0 | 0 | not modify |
| temporary assign to D1 | not shunt | 0 | 0 | not modify |

(unit:sec)

ELEVATOR GROUP CONTROL APPARATUS FOR MULTIPLE ELEVATORS IN A SINGLE ELEVATOR SHAFT

BACKGROUND OF THE INVENTION

1. Field of the Invention

The present invention relates to an apparatus for group control of a plurality of elevators moving in a single elevator shaft.

2. Background Art

A plurality of elevators installed side by side are usually operated through group control. In an ordinary elevator, as is well known, one car moves in one elevator shaft. In association with an increase in the height of recent buildings, as shown in FIG. 2, for example, moving a plurality of cars within a single elevator shaft has been proposed in order to improve the operating efficiency of the elevator and service to the user. In FIG. 2, two cars are moving within each of four elevator shafts; namely, cars A1 and A2 are moving within an elevator shaft #A; cars B1 and B2 are moving within an elevator shaft #B; cars C1 and C2 are moving within an elevator shaft #C; and cars D1 and D2 are moving within an elevator shaft #D.

The most significant point of difference between the case where group control is applied to an ordinary elevator in which one car moves within an elevator shaft and the case where a group control is applied to an elevator in which a plurality of cars move within a single elevator shaft is that the plurality of cars moving within a single elevator must be controlled so as to prevent a collision therebetween.

A group control system taking into consideration the aforementioned problem is described in Japanese Patent Application Laid-open No. Hei-8-133611, which provides a safety measure for preventing collision between the cars. Under this system, for each car there is designated a segment of the shaft into which another car is prohibited from entering, and the other car is controlled so as not to enter the designated segment.

In the group control apparatus that controls the elevators in which a plurality of cars move within each single elevator shaft, car entry prohibition segments are designated to thereby prevent a car from colliding with another. Therefore, such a group control apparatus may be said to be adequate in terms of preventing collision between cars, but must be said to be inadequate in terms of attaining more efficient group control.

The present invention has been conceived to solve the problem described above, and the object of the present invention is to provide an elevator group control apparatus which enables prevention of collision between a plurality of cars within each single elevator shaft and an improvement in operating efficiency.

SUMMARY OF THE INVENTION

According to one aspect of the present invention, an elevator group control apparatus is provided which controls a plurality of cars moving in each single elevator shaft and which determines a car to respond to an elevator-hall call when the elevator-hall call is registered and outputs an operation instruction to the thus-assigned car. The apparatus comprises shunting determination means, shunting planning means and operation control means.

Shunting determination means computes the probability of occurrence of a collision between the cars within the single elevator shaft when the elevator-hall call is registered and determines whether or not the remaining car other than the thus-assigned car must be shunted. Shunting planning means designates a shunting floor when the remaining car is determined to be shunted. Further, operation control means outputs a shunting instruction to the remaining car within the single elevator shaft such that the remaining car moves aside to the thus-designated shunting floor.

According to another aspect of the present invention, an elevator group control apparatus is provided which controls operations of a plurality of cars moving within each single elevator shaft. The apparatus comprises the followings.

Expected arrival time computation means computes expected times at which individual cars arrive at individual floors when an elevator-hall call is registered. Shunting determination means computes the probability of occurrence of a collision between the cars within the single elevator shaft from the positions, states, and expected arrival times of the individual cars within the single elevator shaft and determines whether or not the individual car must be shunted. Shunting planning means designates a shunting floor when the individual car is determined to be shunted and computes a possible shunting start time. Modified expected arrival time computation means modifies the expected arrival times on the basis of the result of the computation performed by the shunting planning means and computes modified times at which the individual cars are expected to arrive at the individual floors when the individual car is shunted. Car-to-be-assigned determination means determines a car to be assigned the elevator-hall call by evaluation of operation conditions of the individual cars being assigned the elevator-hall call, on the basis of the modified expected arrival times. Further, operation control means outputs a shunting instruction to the car to be shunted on the basis of the result of the computation performed by the shunting planning means and outputs an operation instruction to the car assigned the elevator-hall call on the basis of the result of the computation performed by the car-to-be-assigned determination means.

Other and further objects, features and advantages of the invention will appear more fully from the following description.

BRIEF DESCRIPTION OF THE DRAWINGS

FIGS. 1 through 6 show an elevator system according to a first embodiment of the present invention.

FIG. 1 is a block diagram showing the overall configuration of the elevator system.

FIG. 2 shows the layout of cars within the respective elevator shafts.

FIG. 3 is an operation flowchart.

FIG. 4 is a schematic representation for describing the operations of cars.

FIGS. 5A and 5B are tables for describing computation of expected arrival times.

FIG. 6 is a table for describing computation for shunting operation.

FIGS. 7 through 10 show an elevator system according to a second embodiment of the present invention.

FIG. 7 is a block diagram showing the overall configuration of an elevator system.

FIG. 8 shows the layout of cars within respective elevator shafts.

FIGS. 9A and 9B are tables for describing computation of expected arrival times.

FIG. 10 is a table for describing shunting computation.

DETAILED DESCRIPTION OF THE PREFERRED EMBODIMENTS

First Embodiment

Figure 2:
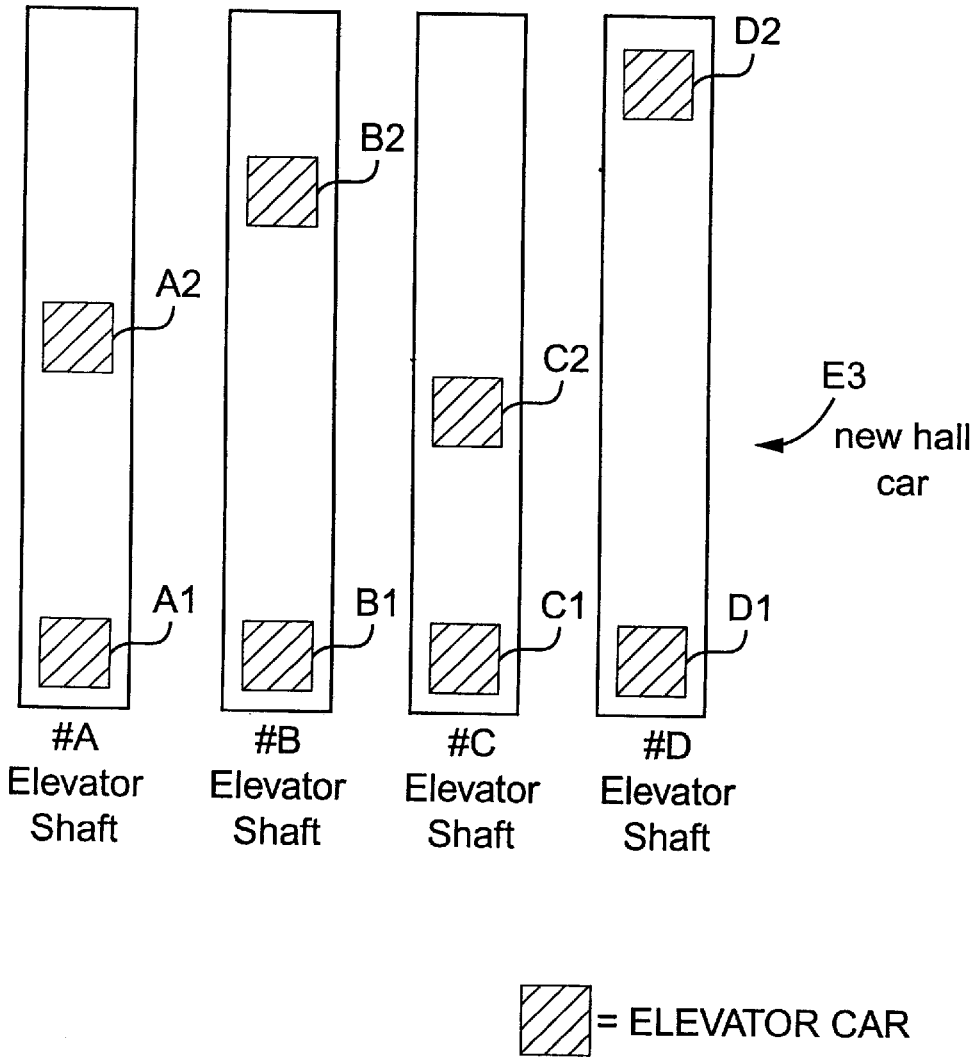
Figure 3:
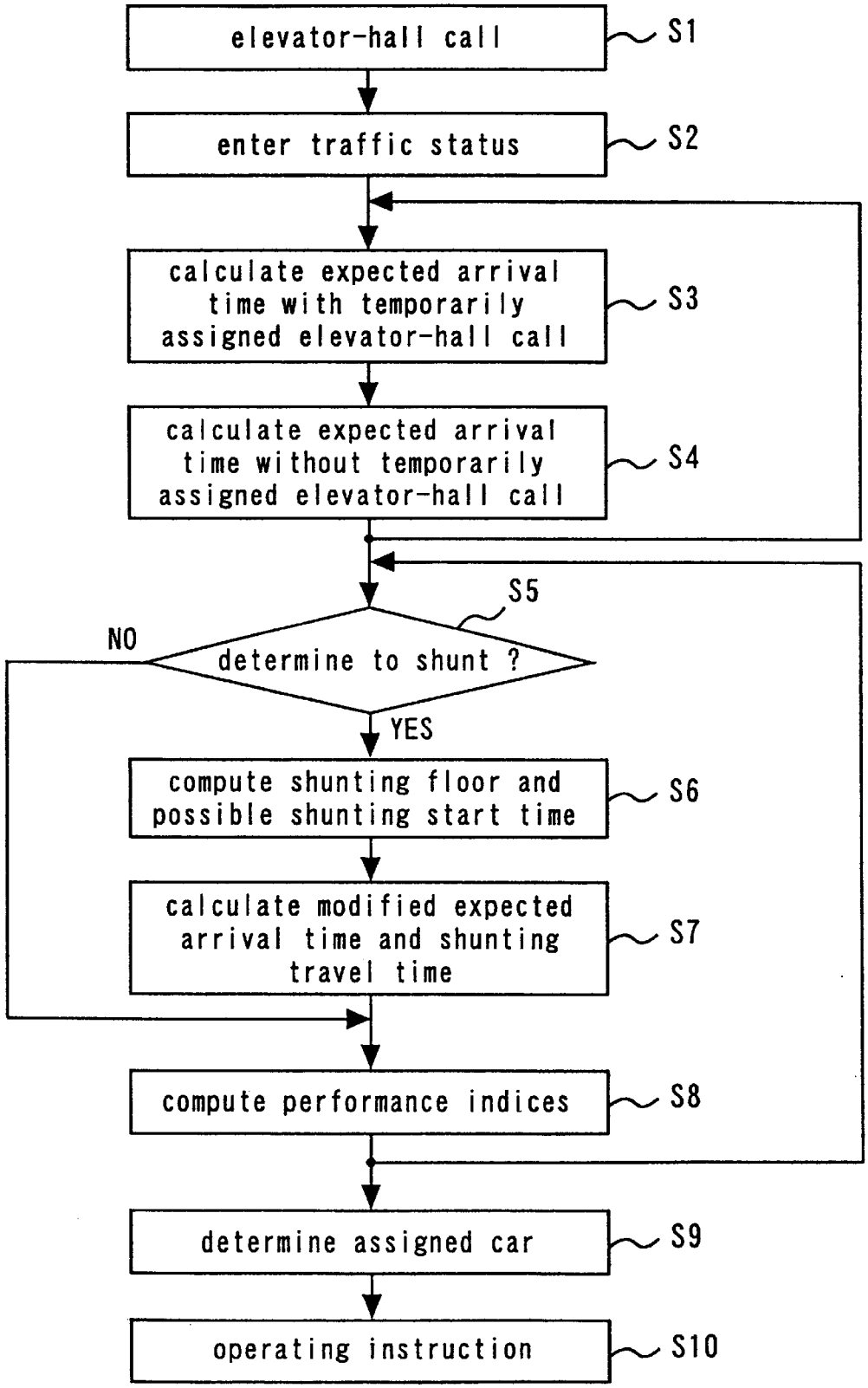
Figure 4:
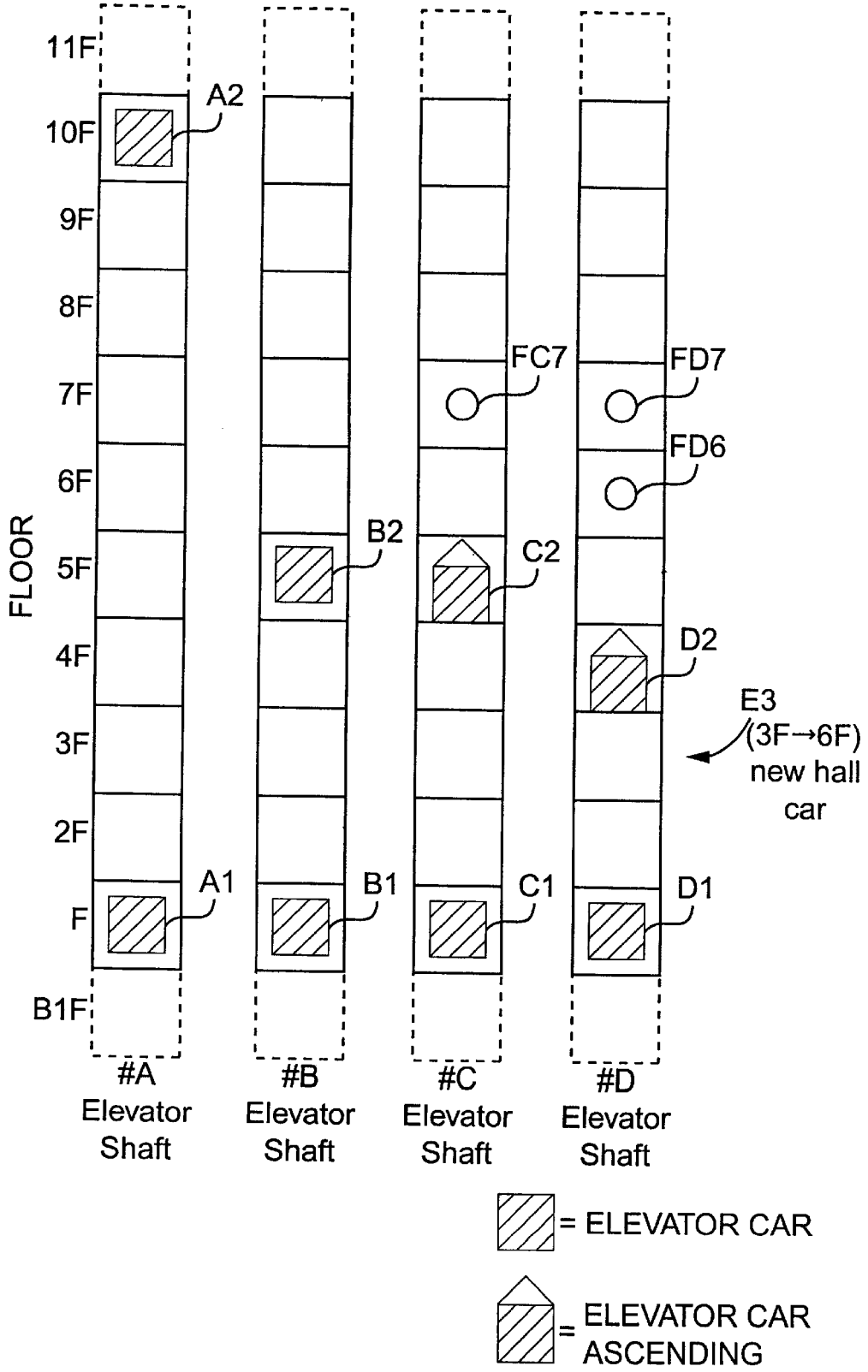

FIGS. 1 through 6 show an elevator system according to a first aspect of the present invention. FIG. 1 is a block diagram showing the overall configuration of the elevator system; FIG. 2 shows the layout of cars within the respective elevator shafts; FIG. 3 is an operation flowchart; FIG. 4 is a schematic representation for describing the operations of cars; FIGS. 5A and 5B are tables for describing computation of expected arrival times; and FIG. 6 is a table for describing computation for shunting operation. Throughout the drawings, like reference numerals designate like elements.

In FIG. 2, #A to #D represent elevator shafts. A1 and A2 are cars provided in the elevator shaft #A, wherein A1 represents a lower car and A2 represents an upper car. B2 and B2 are cars provided in the elevator shaft #B, wherein B1 represents a lower car and B2 represents an upper car. C1 and C2 are cars provided in the elevator shaft #C, wherein C1 represents a lower car and C2 represents an upper car. D1 and D2 are cars provided in the elevator shaft #D, wherein D1 represents a lower car and D2 represents an upper car. E3 represents a newly-registered elevator-hall UP call on the third floor. Although FIG. 2 shows an example relating to four elevator shafts #A to #D, each of which comprises two cars, the number of elevator shafts and the number of cars are not limited thereto. Here, as described in, for example, Japanese Patent Application Laid-open No. Hei-8-133611, the cars A1 to D2 are driven by a linear motor or the like.

In light of the ease with which passengers enter the car at the elevator hall, the number of elevator shafts employed by the ordinary group control is about eight. However, group control per se does not impose any limitation on the number of elevator shafts. The number of cars within each of the elevator shafts #A to #D may be an appropriate number depending on the length of the elevator shaft, as required. For brevity, in the first embodiment, the number of cars provided in each elevator shaft is set to two.

In FIG. 1, reference numeral 1 designates a control apparatus for efficiently group-controlling a plurality of cars; 2A1 designates a controller for controlling the lower car A1 provided in the elevator shaft #A; 2A2 designates a controller for controlling the upper car A2 in the shaft #A; 2B1 designates a controller for controlling the lower car B1 provided in the elevator shaft #B; and 2B2 designates a controller for controlling the upper car B2 in the shaft #B. Similarly, there are also provided a controller 2C1 for controlling the lower car C1 provided in the elevator shaft #C, a controller 2C2 for controlling the upper car C2 in the shaft #C, a controller 2D1 for controlling the lower car D1 provided in the elevator shaft #D, and a controller 2D2 for controlling the upper car D2 in the shaft #D. These controllers 2C1 to 2D2 are omitted from FIG. 1. Reference numeral 3 designates a hall button which comprises UP and DOWN buttons and is provided on each elevator hall.

Reference numeral 4 designates a communications interface which establishes communication and data transmission between the hall button 3 and each of the controllers 2A1 to 2D2; and 5 represents first computation means for computing expected arrival time (hereinafter may be referred to as simple "first computation means"). In a case where an elevator-hall call is registered by the hall button 3, on the assumption that the elevator-hall call will be assigned to a certain car, the first computation means 5 calculates a time at which the car will arrive at an individual floor (hereinafter referred to as a "expected arrival time").

Reference numeral 6 designates second computation means for computing a time at which the car is expected to arrive at the individual floor, in a case where the elevator-hall call is not assigned to any car (hereinafter may be referred to as simply "second computation means"); 7 designates shunting determination means for determining whether or not a car must be shunted in order to prevent a collision within the same elevator shaft, on the basis of the positions and states (e.g., a stationary state or a moving state) of the cars within the same elevator shaft and computation results received from the expected arrival time first and second computation means 5 and 6; and 8 designates shunting planning means for designating a floor to which a car must be shunted, as well as for computing a possible shunting start time if the shunting determination means 7 has determined that shunting is necessary.

Reference numeral 9 designates third computation means for computing a time at which the car is expected to arrive at each floor when the car is shunted (hereinafter may be referred to as "third computation means"), by modification of the computation results yielded by the first and second computation means 5 and 6, on the basis of the result of the shunting planning means 8; 10 designates car allocation means for determining a car to be allocated by comprehensive evaluation of state of service, on the basis of the computation results yielded by one of the first, second, and third computation means 5, 6, and 9; and 11 designates operation control means for outputting an operation instruction to each of the cars according to the computation results yielded by the shunting planning means 8 and the car allocation means 10.

The operation of the elevator system according to the first embodiment will now be described by reference to FIGS. 3 through 6.

As shown in FIG. 4, the lower cars A1 to D1 are situated on the first floor (1F); and the upper car A2 is stationary on the tenth floor (10F); and the upper car B2 is stationary on the fifth floor (5F). The upper car C2 is passing the fifth floor (5F) from below, and the upper car D2 is passing the fourth floor (4F) from below. Reference numeral FC7 designates an in-car destination call which designates the seventh floor registered in the upper car C2; and FD6 and FD7 respectively designate in-car destination calls specifying the sixth and seventh floors registered in the upper car D2.

Both the upper and lower cars can move over the range from the first floor (1F) to the tenth floor (10F). Only the lower cars A1 to D1 can move to the underground floor (B1F) at the lower end of the building, and only the upper cars A2 to D2 can move to the eleventh floor (11F). In some case, these floors (B1F) and (11F) are used as shunting positions.

When an elevator-hall call is issued in step S1 (FIG. 3), a traffic status, such as the status of each of the cars and call registrations, is entered in step S2 by way of the communications interface 4.

Processing operations relating to steps S3 and S4 for the respective cars will now be described. A round of these steps will be described by reference to FIGS. 4 through 6.

When the new elevator-hall call E3 is temporarily assigned to a car, times at which the car is expected to arrive at the individual floors are calculated in step S3. Similarly, when the new elevator-hall call E3 is not assigned to a car, times at which the car is expected to arrive at the individual floors are calculated in step S4. Computation of an expected arrival time per se has conventionally been used in elevator group control and is well known. Therefore, the computation of an expected arrival time is described only briefly.

FIG. 5A shows an example of computation result of expected arrival times for the case where the new elevator-hall UP call E3 from the third floor is temporarily assigned to the lower car A1 of the elevator shaft #A. In FIG. 5A, expected times at which the car will arrive at the individual floors are calculated on the assumption that the lower car A1 moves to the third floor (3F), where passengers enter the car; further moves to the highest floor, i.e., the tenth floor (10F); and then reverses direction. Here, the computation is based on the assumption that moving the car from one floor to another floor takes two seconds and that the car stops for ten seconds per floor.

Expected arrival times must be precisely computed in consideration of speed, acceleration, inter-floor distance, and passenger congestion on individual floors. However, such computation is not directly relevant to the gist of the invention, and hence simplified computation means is described. Passenger(s) who entered the car at the third floor (3F) will exit at any of the seven floors from the fourth floor (4F) to the tenth floor (10F). At this point in time, the floor(s) at which the passenger(s) will exit are unknown. Therefore, the time required for the passenger(s) to exit the car (a stop time of 10 sec.), i.e., 1.43 sec. (10/7=1.43) per floor, is added to the expected arrival time of each of the seven floors from the fourth floor (4F) to the tenth floor (10F). For instance, provided that the passenger will exit at the fifth floor (5F), there will be required a time of 20.86 sec.=17.43 sec. (the time required for the car to travel to the fourth floor)+2 sec. (required for the car to travel over one floor)+1.43 sec.

FIG. 5B shows expected arrival times when the new elevator-hall call E3 is not temporarily assigned a car. In this case, since the lower car A1 is not assigned any call, the lower car A1 can move toward any floor. Therefore, the expected arrival times corresponding to a DOWN elevator-hall call are set so as to become identical with the expected arrival times relating to an UP elevator-hall call.

Expected arrival times of the lower cars B1 to D1 of the elevator shafts #B to #D also assume the same expected arrival times.

As mentioned previously, in steps S3 and S4, expected arrival times of each car are computed for both the case where the new elevator-hall call is temporarily assigned to a car and the case where the new elevator-hall call is not temporarily assigned to a car. In a case where the new elevator-hall call is temporarily assigned to each of the cars, a determination is made as to whether or not the remaining car in each shaft must be shunted at step 5. If shunting is not required, processing jumps to step S8. In contrast, if shunting is required, processing proceeds to step S6.

As shown in FIG. 4, if the new elevator-hall UP call E3 at the third floor is registered and is assigned to any one of the upper cars A2 to D2 of the elevator shafts #A to #D, the thus-assigned car moves upward after having stopped at the third floor (3F), thereby eliminating a necessity for shunting. In contrast, if the new elevator-hall UP call E3 is assigned to any one of the lower cars A1 to D1, a passenger who has entered the thus-assigned car may go to the highest floor. Therefore, the car is determined to be shunted. With regard to a case where a car must be shunted, steps S6 and S7 will now be described with reference to FIG. 6.

In step S6, a shunting floor and a possible shunting start time are computed. First, when the new elevator-hall UP call E3 is temporarily assigned to the lower car A1, the shunting floor of the upper car A2 is set to the eleventh floor (11F). The reason for this is that the destination of a passenger who is waiting for a car and has registered the new elevator-hall UP call E3 from the third floor is unknown at this point in time. Further, the upper car A2 is not assigned any call at this time and, hence, assumes a possible shunting start time of 0. Subsequently, on the assumption that the upper car A2 has started moving to the eleventh floor (11F), the expected arrival time of the upper car A2 is modified in step S7, thereby calculating 12 seconds (=2 seconds for traveling +10 seconds for halt) as a shunting travel time.

In this case, if the upper car A2 starts moving at time 0, the car A2 will not collide with the lower car A1. Hence, the expected arrival time of the lower car A1 does not need to be modified.

Next, if the elevator-hall call E3 is temporarily assigned to the lower car B1, the modification of the expected arrival time of the upper car B2 and computation of a shunting travel time of the same can be carried out, through the same steps used for computing the shunting travel time of the lower car A1. Even in this case, the expected arrival time of the lower car B1 does not need to be modified.

In a case where the elevator-hall call E3 is temporarily assigned to the lower car C1, the upper car C2 becomes ready to be shunted after having responded to the destination call FC7 specifying the seventh floor. Consequently, in this case, the possible shunting start time is 14 seconds (=4 seconds required for the car to travel two floors+10 seconds for halt). If the upper car C2 starts moving at time 14, the car C2 will be prevented from colliding with the lower car C1. In other respects, the same procedure used in modifying the expected arrival time and the shunting travel time of the lower car A1 is followed.

In a case where the elevator-hall call E3 is temporarily assigned to the lower car D1, the upper car D2 responds to the destination call FD6 specifying the sixth floor, as well as to the destination call FD7 specifying the seventh floor. Thereafter, the upper car D2 becomes ready to be shunted. In this case, the time at which the upper car D2 is expected to arrive at the sixth floor (6F) is four seconds, and the time at which the lower car D2 is expected to arrive at the seventh floor (7F) is sixteen seconds. Therefore, the possible shunting start time is 26 sec. (=6 seconds required for the car to travel three floors+20 seconds for stopping at two floors). Modification of the expected arrival time of the upper car D2 and a shunting travel time of the same can be computed in the same manner as employed previously.

In this case, the time at which the upper car D2 will be shunted from the seventh floor (7F) is 26 sec, and the time at which the lower car D1 is expected to arrive at the seventh floor (7F) is 27.72, as shown in FIG. 5A. In order to ensure prevention of a collision between the upper car D2 and the lower car D1 moving within the same elevator shaft #D, a certain difference must be provided between the time at which one car leaves at a certain floor and the time at which another car stops at the same floor. Provided that the time difference is 5 seconds, in this case only a time of 1.72 seconds is available.

For this reason, in order to prevent the lower car D1 from colliding with the upper car D2, the lower car D1 is determined to make a temporary stop at the fourth floor (4F). To ensure the stop, 10 seconds (corresponding to one stop) are added to the shunting travel time of the lower car D1, and the expected arrival time of the lower car D1 is also modified.

Processing proceeds to step S8. Various performance indices are computed on the basis of the expected arrival times calculated so far. Conceivable performance indices comprise waiting time evaluation values, the probability of failure to meet expectation, or the like. However, such performance indices are well known in the field of elevator group control technique, and hence their detailed explanations are omitted here.

In step S9, a car to be assigned the new elevator-hall call is finally determined on the basis of various performance indices including the shunting travel times computed in the steps through step S8. For example, an evaluation function F(e) provided below is used in determining the car to be assigned the new elevator-hall call, and the car which yields an optimum value by means of the evaluation function F(e) is determined to be a car to be assigned the new elevator-hall call.

F(e)=W1×(wait time evaluation value)+W2×(an evaluation value relating to failure to meet expectation)+ . . . +Wn×(shunting travel time evaluation value) where W1, W2, . . . , Wn represent weighting coefficients.

When the car to be assigned the new elevator-hall call is determined in the manner as described above, an assignment instruction and a shunting instruction associated with the assignment instruction are output in step S10.

In the above operation of the elevator system, each step is carried out by each means of the elevator group control apparatus shown in FIG. 1 as follows. That is the step 1 is carried out by expected arrival time first computation means 5; step 2, by expected arrival time second computation means 6; step 5, by shunting determination means 7; step 6, by shunting planning means 8; expected arrival time computation in step 7, by expected arrival time third computation means 9. Further, shunting travel time computation in step 7, and step 8 and step 9, by car allocation means 10; and step 10, by operation control means 11.

As mentioned previously, from the positions and states of the individual cars within the same elevator shaft, the expected arrival times and the possibility of a collision between the cars are computed. If the car is determined to be shunted, the floor to which the car must be shunted and the possible shunting start time are computed. Further, the expected arrival time in a case where the car is shunted is computed by modification of the expected arrival time. On the basis of results of such computation, operating conditions at the time of a car being assigned to a newly-registered elevator-hall call are evaluated, thereby determining a car to be assigned the new elevator-hall call. As a result, an operation efficiency can be improved without involvement of useless travel required for shunting, while a collision between the cars is prevented.

Second Embodiment

Figure 7:
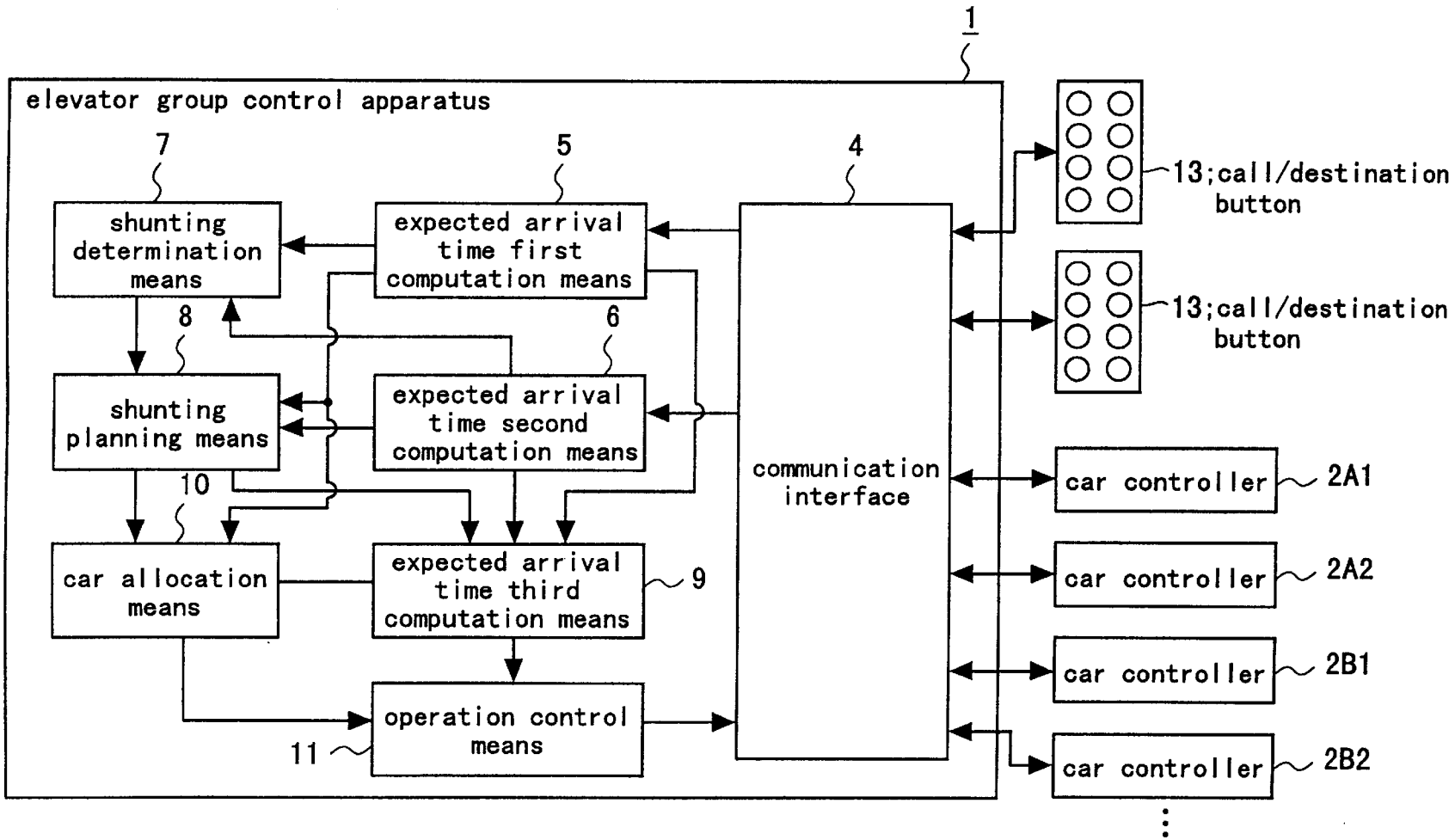
Figure 8:
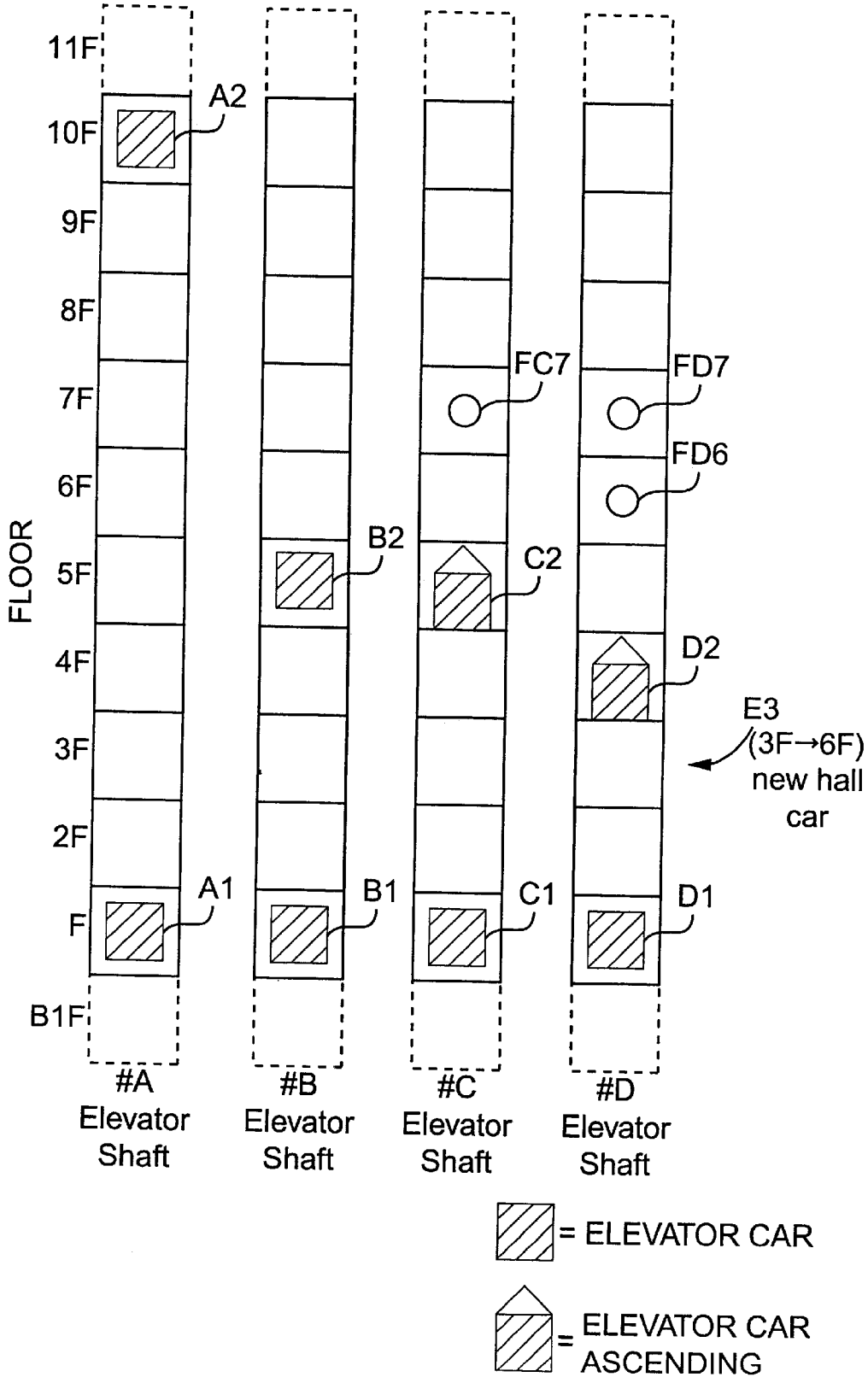

FIGS. 7 through 10 relate to a second embodiment of the present invention. FIG. 7 is a block diagram showing the overall configuration of an elevator system; FIG. 8 shows the layout of cars within respective elevator shafts; FIGS. 9A and 9B are tables for describing computation of expected arrival times; and FIG. 10 is a table for describing shunting computation. FIG. 3 is also used for the second embodiment.

In FIG. 7, reference numeral 13 designates an elevator hall/destination floor button one of which is provided on the elevator hall of each floor and comprising destination buttons. This elevator hall/destination button enables simultaneous registration of an elevator-hall call and a destination call. In other respects, the elevator system shown in FIG. 7 is the same as that shown in FIG. 1.

The operation of the elevator system according to the second embodiment will now be described by reference to FIGS. 8 through 10. The flow of operation of the elevator system is substantially identical with that of the first embodiment.

If an elevator-hall call is issued in step S1, a traffic status is entered in step S2 (See FIG. 3). At this time, in the case of a new elevator-hall call, a destination floor is entered at this point in time. The example shown in FIG. 8 is the same as that shown in FIG. 4. In FIG. 8, the destination floor of the new elevator-hall call E3 from the third floor (3F) is the sixth floor (6F) and is entered at the time of registration of a call. In steps S3 and S4, the expected arrival times are computed for both the case where the new elevator-hall call E3 is temporarily assigned to a car and the case where the new elevator-hall call E3 is not temporarily assigned to any car.

The steps with which the expected arrival times are computed are substantially the same as those employed in the first embodiment. Since the destination floor of the elevator-hall call E3 is determined to be the sixth floor (6F), for example, the lower car A1 will assume the expected arrival times shown in FIGS. 9A and 9B. In FIG. 9A, the lower car A1 is not assigned any call after the sixth floor (6F), the lower car A1 is deemed to be able to reverse direction at the sixth floor (6F). For this reason, the expected arrival times of the lower car A1 when it moves in the downward direction after the seventh floor (7F) to the ninth floor (9F) are the same as those of the lower car A1 when it moves in the upward direction. In the first embodiment, 1.43 seconds/floor are added to each of the expected arrival times, because the destination(s) of the passenger(s) are unknown. In contrast, in the second embodiment, since the destination is known, there is no need to add 1.43 seconds/floor to the expected arrival times.

Subsequently, a determination is made in step S5 as to whether or not shunting is necessary. In the example shown in FIG. 8, the passenger waiting on the third floor (3F) is determined to travel to the sixth floor (6F). If the elevator-hall call E3 is temporarily assigned to the lower car A1, the shunting of the lower car A2 is obviously unnecessary. If the elevator-hall call E3 is temporarily assigned to the lower car C1 or D1, the upper cars C2 and D2 travel to the seventh floor (7F) according to in-car destination calls. Therefore, the upper cars C2 and D2 are not required to be shunted.

If the elevator-hall call is temporarily assigned to the lower car B1, the upper car B2 must be shunted. However, the lower car B1 does not travel beyond the sixth floor (6F). Therefore, the shunting floor for the upper car B2 is set to the seventh floor (7F) in steps S6 and S7. The shunting start time and the shunting travel time of each car are computed as shown in FIG. 10. After completion of the computing operations relating to steps S1 to S7 for each car, a car to be assigned the elevator-hall call is determined, and an operation instruction is output. The procedures for determination of a car and output of an operation instruction have already been described, and hence repetition of their explanations is omitted here.

As mentioned above, the expected arrival times are computed on the basis of the elevator-hall call and the destination floor registered by the elevator hall/destination button 13, thereby designating a shunting floor. When compared with an elevator equipped with an ordinary elevator hall button 3 (see FIG. 1), the elevator according to the present embodiment enables more accurate computation of expected arrival times. Further, a shunting floor can be set to a position which minimizes the distance over which the car is to be shunted, thus rendering group control more efficient.

In the previous embodiments, a plurality of cars are disposed within each single elevator shaft. As in the case with the previous embodiments, the present invention may also be applied to an elevator whose elevator shaft is bifurcated, wherein only a specific car moves in each branch of the bifurcated shaft.

The effects and advantages of the present invention may be summarized as follows.

As has been described above, according to a first aspect of the present invention, when an elevator-hall call is registered, the probability of occurrence of a collision between cars is computed. A determination is made as to whether or not the remaining car must be shunted. If the remaining car is determined to be shunted, a shunting floor is designated. A shunting instruction is output such that the remaining car moves to the shunting floor, thereby enabling the car assigned the elevator-hall call to respond to the elevator-hall call without colliding with the remaining car.

According to a second aspect of the present invention, the expected times at which each car arrives at the individual floors are computed. The probability of occurrence of a collision between the cars is computed from the positions, states, and expected arrival times of the cars. A determination is made as to whether or not any car must be shunted. If the remaining car is determined to be shunted, a shunting floor is designated, and a possible shunting start time is computed. The expected arrival times are modified on the basis of result of such computation. Modified and expected times at which the individual cars arrive at the individual floors in a case where the remaining car is shunted are computed. On the basis of result of such computation, operation conditions at the time of assigning the elevator-hall call to each of the cars are evaluated, thereby determining a car to be assigned the elevator-hall call. Further, a shunting instruction is output to the remaining car, and an operation instruction is output to the thus-assigned car.

The assigned car can respond to the elevator-hall call without colliding with the remaining car, thus improving operating efficiency.

According to a third aspect of the present invention, an elevator hall/destination button is disposed on each floor, thereby enabling simultaneous registration of an elevator-hall call from a floor and a destination floor of the passenger. When compared with an elevator equipped with an ordinary elevator-hall button, the elevator according to the present invention enables more accurate computation of expected arrival times. Further, the shunting floor can be designated at a position which minimizes the distance over which the remaining car travels for shunting, thus rendering group control more efficient.

According to a fourth aspect of the present invention, a car to be assigned a call is determined on the basis of modified expected arrival times by comprehensive evaluation of operating conditions at the time of an elevator-hall call being assigned to each of the cars, as well as evaluation of the time required for the remaining car to move aside. As a result, useless travel of the car required to be shunted is eliminated, thereby improving operating efficiency.

According to a fifth aspect of the present invention, computation of expected arrival times is achieved by computation of times at which individual cars are expected to arrive at individual floors when an elevator-hall call is assigned to the car, and by computation of times at which individual cars are expected to arrive at the individual floors when the elevator-hall call is not assigned to any car. As a result, a highly precise determination can be made as to whether or not the remaining car must be shunted.

Obviously many modifications and variations of the present invention are possible in the light of the above teachings. It is therefore to be understood that within the scope of the appended claims the invention may by practiced otherwise than as specifically described.

The entire disclosure of a Japanese Patent Application No. 11-25949, filed on Feb. 3, 1999 including specification, claims, drawings and summary, on which the Convention priority of the present application is based, is incorporated herein by reference in its entirety.

What is claimed is:

1. An elevator group control apparatus for controlling a plurality of elevator cars moving up and down within a single elevator shaft, for assigning one of the elevator cars to respond to an elevator-hall call when the elevator-hall call is registered, and for outputting an operation instruction to the car so assigned, the apparatus comprising:

shunting determination means for computing probability of a collision between elevator cars moving up and down within a single elevator shaft when an elevator-hall call is registered and determining whether a remaining car, not the car assigned to respond to the elevator-hall call, must be shunted to a floor within the single elevator shaft to avoid a collision;

shunting planning means for designating a shunting floor within the single elevator shaft when the remaining car is to be shunted; and operation control means for outputting a shunting instruction to the remaining car within the single elevator shaft such that the remaining car moves to the shunting floor within the single elevator shaft.

2. An elevator group control apparatus for controlling operations of a plurality of elevator cars moving up and down within a single elevator shaft, the apparatus comprising:

expected arrival time computation means for computing expected times each of two individual cars moving up and down within a single elevator shaft will arrive at individual floors in response to registration of an elevator-hall call;

shunting determination means for computing probability of a collision between the cars moving up and down within the single elevator shaft from positions, states, and the expected times the cars moving up and down within the single elevator shaft will arrive at individual floors and for determining whether one of the cars must be shunted to a floor within the single elevator shaft to avoid a collision;

shunting planning means for designating a shunting floor within the single elevator shaft when one of the cars is to be shunted and for computing a possible shunting start time;

modified expected arrival time computation means for modifying the expected times from the possible shunting start time and for computing modified times at which the respective cars are expected to arrive at the individual floors when one of the cars is shunted to a floor within the single elevator shaft;

car-to-be-assigned determination means for assigning one of the cars to respond to the elevator-hall call by evaluation of operation conditions of the respective cars from the modified times; and operation control means for outputting a shunting instruction to the car to be shunted to a floor within the single elevator shaft from the shunting start time and outputting an operation instruction to the car assigned to respond to the elevator-hall call determined by the car-to-be-assigned determination means.

3. The elevator group control apparatus as defined in claim 2, wherein an elevator hall/destination button is provided on each floor enabling simultaneous registration of an elevator-hall call from a floor and of a destination floor of a passenger.

4. The elevator group control apparatus as defined in claim 2, wherein the car-to-be-assigned determination means determines the car to be assigned to respond to the elevator-hall call by evaluating operation conditions of the car assigned to respond to the elevator-hall call and the time required for the other cars to be shunted, from the modified times.

5. The elevator group control apparatus as defined in claim 2, wherein the expected arrival time computation means comprises first computation means for computing times at which individual cars are expected to arrive at individual floors assuming the elevator-hall call is temporarily assigned to the individual cars when the elevator-hall call is registered, and second computation means for computing times at which the individual cars are expected to arrive at the individual floors assuming the elevator-hall call is not assigned to any car.

6. The elevator group control apparatus as defined in claim 1, including only two elevator cars in the single elevator shaft.

7. The elevator group control apparatus as defined in claim 2, including only two elevator cars in the single elevator shaft.

* * * * *